US005476087A

United States Patent [19]

Kunimoto

[11] Patent Number: 5,476,087

[45] Date of Patent: Dec. 19, 1995

[54] MODEL GUN WITH AUTOMATIC BULLET SUPPLYING MECHANISM

[75] Inventor: Keiichi Kunimoto, Tokyo, Japan

[73] Assignee: Western Arms, Tokyo, Japan

[21] Appl. No.: 305,054

[22] Filed: Sep. 13, 1994

[30] Foreign Application Priority Data

Oct. 8, 1993 [JP] Japan ..... 5-252881

[51] Int. Cl.[6] ..... F41B 11/06

[52] U.S. Cl. ..... 124/73; 124/74; 124/75

[58] Field of Search ..... 124/73, 72, 71, 124/70, 69, 74, 75, 76, 56, 31

[56] References Cited

U.S. PATENT DOCUMENTS

| | | | |
|---|---|---|---|
| 2,566,181 | 8/1951 | Fitch | 124/70 X |
| 2,881,752 | 4/1959 | Blahnik | 124/75 |
| 5,063,905 | 11/1991 | Farrell | 124/74 X |
| 5,280,778 | 1/1994 | Kotsiopoulos | 124/73 |

FOREIGN PATENT DOCUMENTS

| | | | |
|---|---|---|---|
| 341408 | of 1959 | Germany | 124/74 |
| 1285798 | 11/1989 | Japan | 124/72 |
| 338593 | 4/1991 | Japan | 124/72 |
| 3221793 | 9/1991 | Japan | 124/72 |
| 3236598 | 10/1991 | Japan | 124/71 |
| 5-8285 | 5/1993 | Japan . | |

*Primary Examiner*—Eric K. Nicholson
*Assistant Examiner*—Harry C. Kim
*Attorney, Agent, or Firm*—Sixbey, Friedman, Leedom & Ferguson; Gerald J. Ferguson, Jr.; David S. Safran

[57] ABSTRACT

A model gun with automatic bullet supplying mechanism comprises a slider provided to be movable along the barrel, a movable member provided to be movable along moving directions of the slider between a bullet holding chamber provided at the back of the barrel and a pressure receiving portion fixed in the slider to be positioned at the back of the barrel and movable with the slider, and a gas passage controller provided to be movable in the movable member. The gas passage controller is operative selectively to control a first gas passage extending from a pressure accumulating chamber through the movable member to the bullet holding chamber to be open so that gas discharged from the pressure accumulating chamber is supplied through the first gas passage to the bullet holding chamber and to control a second gas passage extending from the pressure accumulating chamber through the movable member to the pressure receiving portion to be open so that gas discharged from the pressure accumulating chamber acts through the second gas passage on the pressure receiving portion to cause first the slider to move back and then the movable member also to move back for making preparations for supplying the bullet holding chamber with a sham bullet from a magazine for containing sham bullets.

6 Claims, 15 Drawing Sheets

MODEL GUN WITH AUTOMATIC BULLET SUPPLYING MECHANISM

BACKGROUND OF THE INVENTION

1. Field of the Invention

The present invention relates generally to a model gun with automatic bullet supplying mechanism, and more particularly to an improvement in a model gun having an automatic bullet supplying mechanism which is operative to supply automatically a bullet holding chamber provided just at the back of a barrel with a sham bullet which is to be shot with gas pressure.

2. Description of the Prior Art

A model gun which is often called an air soft gun is made to imitate a real gun in not only its color and shape but also its apparent operations. As for one of these model guns, which is made to imitate a real gun having a slider provided to be able to move back and forward along a barrel thereof in accordance with triggering action, it has been proposed to make such an arrangement that gas pressure is used for supplying a bullet holding chamber provided just at the back of a barrel with a sham bullet and further for shooting the sham bullet put in the bullet holding chamber, as shown in, for example, Japanese patent application published before examination under publication number 3-38593. According to the arrangement thus proposed, a pressure accumulating bomb in which compressed air is contained and which has an air leading passage controlled to be open and closed selectively by an operation valve, a magazine for containing sham bullets, first and second valves, first and second air passages and a bullet supplying lever are provided in a grip, an air cylinder is positioned in a slider which is provided to be able to move back and forward along a barrel to be opposite to the rear end of the barrel with a magazine plate between, and a rotary cam engaging with the magazine plate to move the same upward and downward and a spring guide member which moves together with the slider are further provided, so that each of the sham bullets contained in the magazine is supplied to the inside of the barrel and then shot through the barrel with the compressed air discharged from the pressure accumulating bomb.

In a model gun to which the above mentioned arrangement is applied, when a trigger is pulled, the first valve is caused to operate for permitting the compressed air discharged through the air leading passage opened by the operation valve from the pressure accumulating bomb to be introduced through the first air passage into the inside of the air cylinder and a piston provided in the air cylinder is moved with the pressure of the compressed air to cause the slider to move back. The air cylinder is shifted into the air exhausting condition after the slider has moved back to a predetermined position. The spring guide member also moves back together with the slider to compress a spring member and thereby the rotary cam is rotated to move the magazine plate downward. A bullet holding hole formed on the magazine plate is positioned to be opposite to the sham bullet if the sham bullet is pushed out of the magazine for containing sham bullets when the magazine plate is moved downward. Then, the sham bullet which has been pushed out of the magazine for containing sham bullets is put in the bullet holding hole on the magazine plate by the bullet supplying lever moved together with the trigger.

After that, when the slider returns to the initial position under a condition wherein the air is exhausted from the air cylinder, the spring member is operative to return the spring guide member to the initial position thereof and therefore the rotary cam is rotated to move the magazine plate upward so that the bullet holding hole on the magazine plate in which the sham bullet is put is moved to the initial position to be opposite to the rear end of the barrel. When the magazine plate holding the sham bullet in the bullet holding hole formed thereon has reached the initial position, the second valve is caused to operate for permitting the compressed air discharged through the air leading passage opened by the operation valve from the pressure accumulating bomb to be introduced through the second air passage into the bullet holding hole formed on the magazine plate by a hammer which rotates with the movement of the trigger and the sham bullet put in the bullet holding hole is shot through the barrel with the compressed air introduced into the bullet holding hole.

With the previously proposed model gun in which the air cylinder is provided to form a pressure chamber in the slider which is provided to be movable along the barrel and the sham bullet is supplied to the bullet holding hole formed on the magazine plate by supplying the pressure chamber with the compressed air and discharging the compressed air from the pressure chamber as described above, it is possible to shoot a plurality of sham bullets successively under the automatic bullet supplying operation. However, since an air passage controller which comprises a plurality of valves and is operative to supply the pressure chamber and the bullet holding hole formed on the magazine plate selectively with the compressed air discharged from the pressure accumulating bomb is provided in the grip and therefore a distance from the air passage controller to each of the pressure chamber and the bullet holding hole is relatively long, each of the air passage extending from the pressure accumulating bomb to the pressure chamber and the air passage extending from the pressure accumulating bomb to the bullet holding hole is so complicated in its construction. Further, the consumption of compressed air discharged from the pressure accumulating bomb is undesirably increased.

OBJECTS AND SUMMARY OF THE INVENTION

Accordingly, it is an object of the present invention to provide a model gun with automatic bullet supplying mechanism, in which a bullet holding chamber to which a sham bullet is supplied to be shot with gas pressure is provided just at the back of a barrel and a pressure acting device operative to make preparations for supplying the bullet holding chamber with the sham bullet by using gas pressure supplied thereto is provided in a slider which is provided to be movable along the barrel, and which avoids the aforementioned disadvantages encountered with the prior art.

Another object of the present invention is to provide a model gun with automatic bullet supplying mechanism, in which a bullet holding chamber to which a sham bullet is supplied to be shot with gas pressure is provided just at the back of a barrel and a pressure acting device operative to make preparations for supplying the bullet holding chamber with the sham bullet by using gas pressure supplied thereto is provided in a slider which is provided to be movable along the barrel, and in which the pressure acting device is simplified in its construction.

A further object of the present invention is to provide a model gun with automatic bullet supplying mechanism, in which a bullet holding chamber to which a sham bullet is supplied to be shot with gas pressure is provided just at the back of a barrel and a pressure acting device operative to make preparations for supplying the bullet holding chamber with the sham bullet by using gas pressure supplied thereto is provided in a slider which is provided to be movable along the barrel, and which has a gas passage controller provided for supplying the pressure acting device and the bullet holding chamber selectively with compressed gas discharged from a pressure accumulating chamber and located at such a position that each of a gas passage extending from the pressure accumulating chamber to the pressure acting device and a gas passage extending from the pressure accumulating chamber to the bullet holding chamber can be simplified in its construction.

A still further object of the present invention is to provide a model gun with automatic bullet supplying mechanism, in which a bullet holding chamber to which a sham bullet is supplied to be shot with gas pressure is provided just at the back of a barrel and a pressure acting device operative to making preparations for supplying the bullet holding chamber with the sham bullet by using gas pressure supplied thereto is provided in a slider which is provided to be movable along the barrel, and by which gas consumption required to supply the bullet holding chamber with the sham bullet and then to shoot the sham bullet in the bullet holding chamber through the barrel can be reduced effectively.

According to the present invention, there is provided a model gun with automatic bullet supplying mechanism, which comprises a magazine for containing sham bullets provided in a grip, a pressure accumulating chamber provided in the grip for accumulating gas pressure, a bullet holding chamber provided just at the back of a barrel to be close to one end of the magazine, a slider provided to be movable along the barrel, a pressure receiving portion fixed in the slider to be positioned at the back of the barrel and movable with the slider, a movable member provided between the bullet holding chamber and the pressure receiving portion to be movable along moving directions of the slider, and a gas passage controller provided to be movable in the movable member for controlling each of a first gas passage extending from the pressure accumulating chamber through the movable member to the bullet holding chamber and a second gas passage extending from the pressure accumulating chamber through the movable member to the pressure receiving portion to be open and closed selectively, wherein the gas passage controller is operative selectively to control the first gas passage to be open so that gas discharged from the pressure accumulating chamber is supplied through the first gas passage to the bullet holding chamber and to control the second gas passage to be open so that gas discharged from the pressure accumulating chamber acts through the second gas passage on the pressure receiving portion to cause first the slider to move back and then the movable member also to move back for making preparations for supplying the bullet holding chamber with the sham bullet from the end of the magazine.

The pressure receiving portion in the slider is provided in the form of, for example, the bottom of a cup-shaped member fixed to the slider and the gas is discharged from the second gas passage into the inside of the cup-shaped member toward the bottom of the same when the gas passage controller operates to control the second gas passage to be open. Further, in the case where the pressure receiving portion in the slider is provided in the form of the bottom of the cup-shaped member fixed to the slider, a rear portion of the movable member through which a part of the second gas passage is formed is positioned selectively in and out of the tubular portion of the cup-shaped member.

In the model gun thus constituted in accordance with the present invention, a pressure acting device operative to make preparations for supplying the bullet holding chamber with the sham bullet by using the gas pressure supplied thereto is constituted by the pressure receiving portion in the slider, which is provided in the form of, for example, the bottom of the cup-shaped member fixed to the slider, and the gas passage controller provided in the movable member which has the rear portion thereof, through which a part of the second gas passage is formed and which is positioned, for example, selectively in and out of the tubular portion of the cup-shaped member, and operative to cause the gas from the pressure accumulating chamber to act through the second gas passage on the pressure receiving portion. Therefore, the pressure acting device is so provided as to operate surely with simplified construction. Besides, the preparations for supplying the bullet holding chamber with the sham bullet by using the gas pressure are carried out by the pressure acting device efficiently and rapidly with relatively small quantity of gas.

Further, the gas passage controller operative to control each of the first gas passage extending from the pressure accumulating chamber provided in the grip through the movable member to the bullet holding chamber and the second gas passage extending from the pressure accumulating chamber through the movable member to the pressure receiving portion to be open and closed selectively is provided in the movable member which is positioned above the grip between the bullet holding chamber and the pressure receiving portion. Since the gas passage controller is provided in the movable member positioned above the grip in which the pressure accumulating chamber is provided in such a manner as mentioned above, portions of the first and second gas passages in the grip are formed to be common to the first and second gas passages and a distance from the gas passage controller to each of the bullet holding chamber and the pressure receiving portion is made relatively short so that each of portions of the first and second gas passages in the movable member is shortened. Consequently, each of the first and second gas passages is shortened in its entirety and relatively simplified in its construction, and the consumption of the gas discharged from the pressure accumulating chamber, which is required to supply the bullet holding chamber with the sham bullet and then to shoot the sham bullet in the bullet holding chamber through the barrel, is effectively reduced.

In addition, since the portions of the first and second gas passages in the grip are formed to be common to the first and second gas passages and relatively simplified in construction, it is easily achieved to modify the pressure accumulating chamber so as to have enlarged capacity in the grip. Further, since the consumption of the gas discharged from the pressure accumulating chamber is effectively reduced and therefore the gas pressure in the pressure accumulating chamber is gently reduced, various portions operating with the gas discharged from the pressure accumulating chamber, such as the slider, can be smoothly moved for a relatively long time after the pressure accumulating chamber is charged with the gas.

The above, and other objects, features and advantages of the present invention will become apparent from the following detailed description taken in conjunction with the accompanying drawings.

DESCRIPTION OF THE PREFERRED EMBODIMENTS

Figure 1:
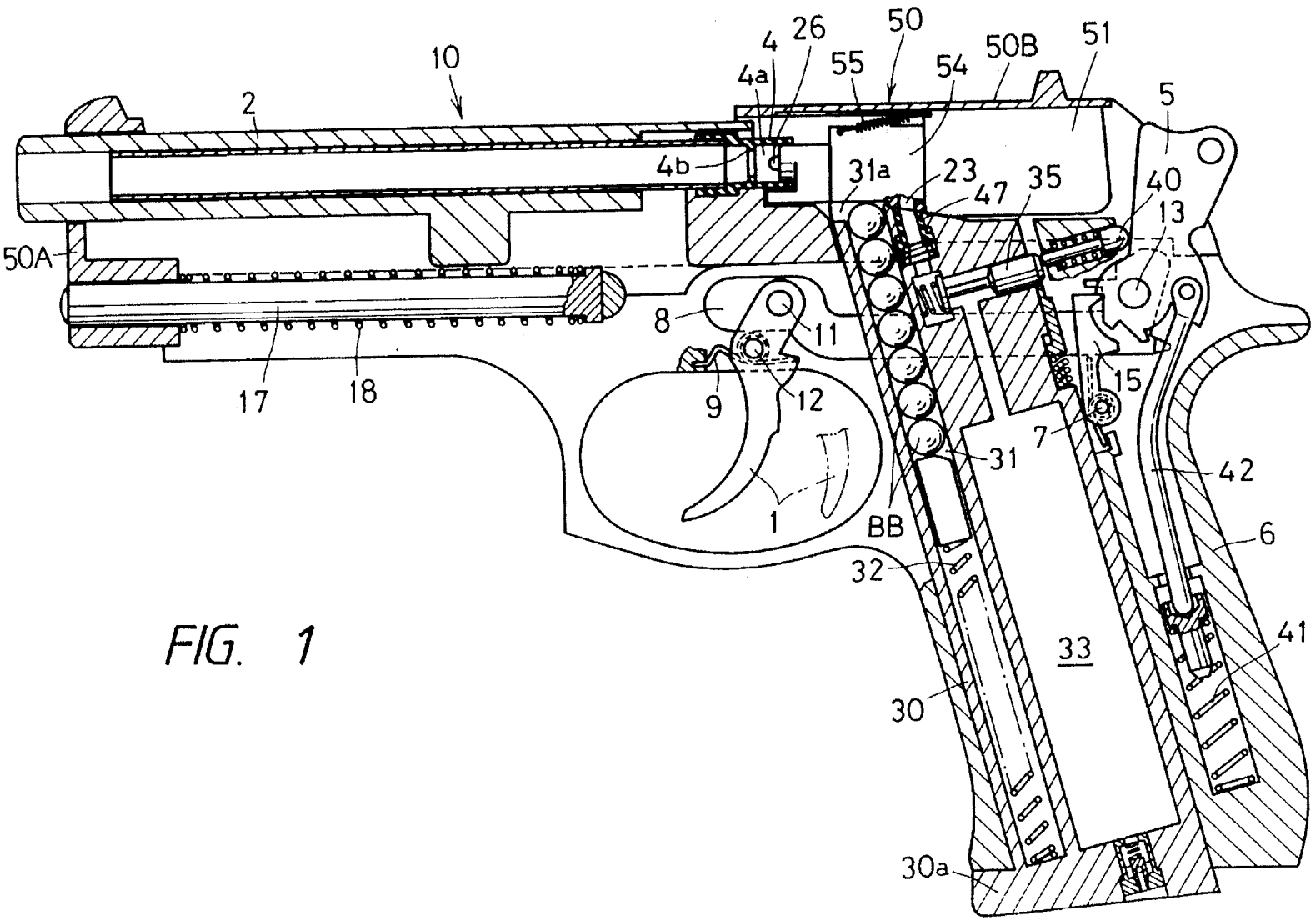
FIG. 1 is a schematic cross sectional view showing an embodiment of model gun with automatic bullet supplying mechanism according to the present invention.
Figure 2:
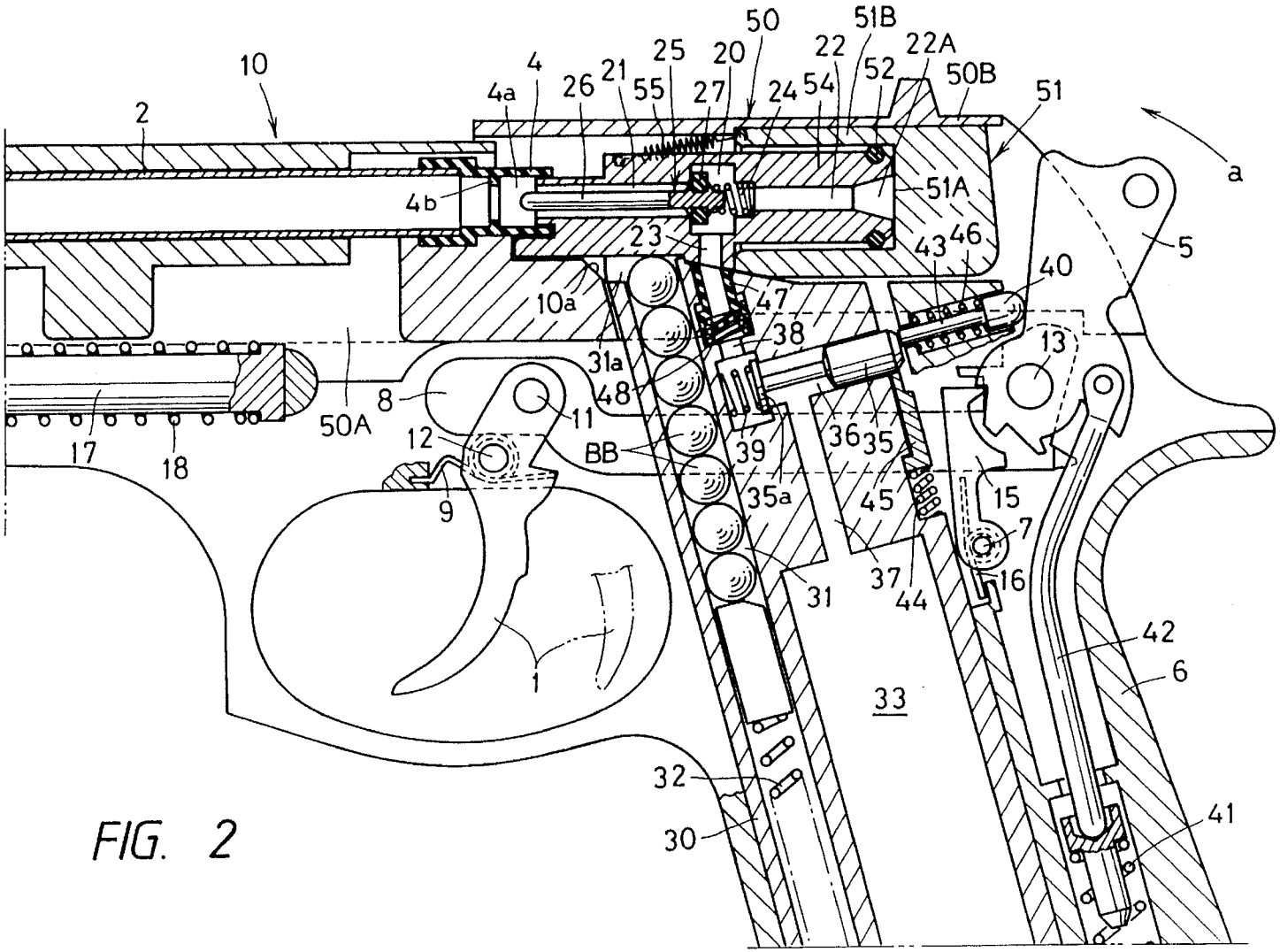
FIG. 2 is a schematic cross sectional view showing essential portions of the embodiment shown in FIG. 1.

FIGS. 1 and 2 show an embodiment of model gun with automatic bullet supplying mechanism according to the present invention.

Referring to FIG. 1, the embodiment has a body 10 in which a trigger 1, a barrel 2, a bullet holding chamber 4*a* positioned just at the back of the barrel 2, a hammer 5 and grip 6 are provided, a case 30 held to be detachable in the grip 6, and a slider 50 provided to be movable along the barrel 2. The bullet holding chamber 4*a* is formed in a rear portion of a tubular member 4 made of elastic frictional material, such as rubber. A front portion of the tubular member 4 is coupled with a rear end portion of the barrel 2. The tubular member 4 has a ring projection 4*b* provided on the inner surface to partition the rear and front portions.

A movable bar member 8 is provided in the grip 6 and the trigger 1 is attached to be rotatable to the body 10 with an axis 12 and a toggle spring 9 and connected with an axis 11 standing on a front portion of the movable bar member 8, which projects outward from the grip 6. When triggering, the trigger 1 is rotated of the axis 12 against the elastic force by the toggle spring 9 from a reference position as shown with a solid line in FIG. 1 to a finishing position as shown with a double dot-dash line in FIG. 1. A rotary lever 15 attached with an axis 7 to the grip 6 is provided at the rear portion of the movable bar member 8, and the movable bar member 8 is moved to go forward and back in accordance with the rotations of the trigger 1 and rotated on the axis 11 in accordance with the movements of the slider 50 to cause the rotary lever 15 to rotate.

The slider 50 has a front portion 50A and a rear portion 50B which is incorporated with the front portion 50A to be positioned at the back of the barrel 2 and is attached to be movable to a portion of the body where the barrel 2 is provided. When the trigger 1 is put in the reference position, the slider 50 is put in a reference position with the front end of the front portion 50A positioned to be close to a front end of the body 10 and the rear portion 50B positioned to cover a mid portion of the body 10 between the barrel 2 and the grip 6, as shown in FIG. 1. The front portion 50A of the slider 50 is also engaged with a guide member 17 which extends along the barrel 2 in front of the trigger 1. The guide member 17 is provided with a coil spring 18 which is concerned through the guide member 17 with the front portion 50A of the slider 50 and is operative to exert the elastic force to the front portion 50A to put the same in tendency of moving forward.

In the rear portion 50B of the slider 50, as shown in FIG. 2, a cup-shaped member 51 is provided to be fixed to the rear portion 50B and movable with the slider 50. A bottom of the cup-shaped member 51 constitutes a pressure receiving portion 51A.

Further, in the rear portion 50B of the slider 50, a movable member 54 is also provided. The movable member 54 is positioned between the bullet holding chamber 4*a* and the pressure receiving portion 51A and has a rear portion which is put selectively in and out of a tubular portion 51B of the cup-shaped member 51, a front portion which is coupled selectively with the rear portion of the tubular member 4 in which the bullet holding chamber 4*a* is formed, and a mid portion between the rear and front portions. A sealing ring member 52 made of elastic material is mounted on the rear end of the rear portion of the movable member 54. When the rear portion of the movable member 54 is inserted in the tubular portion 51B of the cup-shaped member 51, the sealing ring member 52 comes into contact with the inner surface of the tubular portion 51B to seal hermetically a space between the outer surface of the rear portion of the movable member 54 and the inner surface of the tubular portion 51B.

A coil spring 55 is provided with one end attached to the tubular portion 51B of the cup-shaped member 51 and the other end attached to the movable member 54 for exerting the elastic force to the movable member 54 to put the same in tendency of moving toward the pressure receiving portion 51A which is provided in the form of the bottom of the cup-shaped member 51. When the slider 50 is put in the reference position, the movable member 54 is put in such a position as to cause the front portion thereof to be coupled with the rear portion of the tubular member 4 in which the bullet holding chamber 4*a* is formed and to cause the rear portion thereof to be inserted in the tubular portion 51B of the cup-shaped member 51.

The movable member 54 is provided therein with a center space 20, a bullet shooting gas passage 21 extending from the center space 20 toward a front end of the movable member 54, a bullet supplying gas passage 22 extending from the center space 20 toward a rear end of the movable member 54, and a common gas passage 23 extending from the center space 20 toward the grip 6. A gas exhausting nozzle portion 22A having a relatively large diameter is formed at the rear end of the bullet supplying gas passage 22 and a step portion with which one end of a coil spring 24 is engaged is formed at the front end of the bullet supplying gas passage 22 facing to the center space 20. Further, a gas passage controller 25 is also provided to be movable in the movable member 54.

The gas passage controller 25 is constituted by a rod 26 extending from the center space 20 through the bullet shooting gas passage 21 to the bullet holding chamber 4*a* and a valve 27 mounted on the rod 26 to be put in the center space 20. The rod 26 constituting the gas passage controller 25 is pushed toward the bullet holding chamber 4*a* by the coil spring 24 which has the other end engaging with the rear end of the rod 26 to exert the elastic force to the rod 26. The valve 27 constituting the gas passage controller 25 is provided in the form of an elastic sealing ring member and operative to move between the bullet shooting gas passage 21 and the bullet supplying gas passage 22 in accordance with the movements of the rod 26 for controlling each of the bullet shooting gas passage 21 and the bullet supplying gas passage 22 to be open and closed selectively.

The gas passage controller 25 provided in the movable member constitutes, together with the pressure receiving portion 51A provided in the form of the bottom of the cup-shaped member 51, a pressure acting device which is provided in the slider 50 and operative to make preparations for supplying the bullet holding chamber 4*a* with a sham bullet by using gas pressure supplied thereto.

The hammer 5 is attached to be rotatable with an axis 13 to a rear end of the body 10. In an initial condition wherein the case 30 is inserted into the grip 6, the hammer 5 is positioned, for example, to be in contact with a rear end of a movable pin 40 projecting from the grip 6 and to engage with the rotary lever 15. The movable pin 40 is pushed toward the hammer 5 with the elastic force by a coil spring 46 which is put on a rod 43 extending from the movable pin 40 to exert the elastic force to the movable pin 40. The rotary lever 15 is forced to rotate to be close to the hammer 5 by a toggle spring 16 provided on the axis 7 for exerting the elastic force to the hammer 5. One end portion of a rod member 42, which has the other end portion engaging with a coil spring 41 provided in a lower portion of the grip 6, is connected to the hammer 5 and thereby the hammer 5 is forced to rotate in a direction indicated by an arrow a in FIG. 2 (a direction) by the coil spring 41.

The case 30 is inserted into the grip 6 through an opening provided at a lower end portion of the grip 6 and a bottom portion 30*a* of the case 30 is engaged with the lower end portion of the grip 6 so that the case 30 is held in the grip 6.

The case 30 is provided therein with a magazine 31 for containing sham bullets BB, in which a coil spring 32 is provided for pushing the sham bullets BB toward an upper end portion 31*a* of the magazine 31, a pressure accumulating chamber 33 which is charged with, for example, liquefied gas, a connecting gas passage 36 in which a piston 35 is put to be movable for making one end portion of the connecting gas passage 36 closed, a lower gas passage 37 extending to connect the pressure accumulating chamber 33 with the connecting gas passage 36, and an upper gas passage 38 extending to be connected through the connecting gas passage 36 to the lower gas passage 37. The piston 35 put in the connecting gas passage 36 has a valve portion 35*a* operative to make the other end portion of the connecting gas passage 36 open and closed selectively in accordance with the movements thereof in the connecting gas passage 36. The piston 35 is pushed toward the outside of the case 30 by a coil spring 39 which is put in a connecting portion between the connecting gas passage 36 and the upper gas passage 38 for exerting the elastic force to the piston 35.

A movable tubular sealings member 47 made of elastic material, such as rubber, and a coil spring 48 for exerting the elastic force to the movable tubular sealing member 47 to push up the same toward the outside of the upper gas passage 38 are provided in the upper portion of the upper gas passage 38. The movable tubular sealing member 47 has the lower portion having a relatively large diameter to make a step and the upward movement of the movable tubular sealing member 47 caused by the coil spring 48 is limited to project slightly from the upper end portion of the upper gas passage 38 by the lower portion thereof engaged with a step provided in the upper gas passage 38.

The movable tubular sealing member 47 constitutes a coupling portion between the common gas passage 23 provided in the movable member 54 and the upper gas passage 38, and the upper end of the movable tubular sealing member 47 comes into contact with the portion of the outer surface of the movable member 54 at which the common gas passage 23 opens when the slider 50 is put in the reference position, as shown in FIGS. 1 and 2. Since the movable tubular sealing member 47 is pushed up toward the movable member 54 by the coil spring 48, the upper end of the movable tubular sealing member 47 is kept in secure contact with the outer surface of the movable member 54 and therefore the common gas passage 23 provided in the movable member 54 is hermetically connected with the upper gas passage 38 when the slider 50 is put in the reference position.

The lower gas passage 37, which extends to connect the pressure accumulating chamber 33 with the connecting gas passage 36 in which the piston 35 having the valve portion 35*a* is provided, and the upper gas passage 38, which extends to connect the connecting gas passage 36 through the coupling portion constituted by the movable tubular sealing member 47 with the common gas passage 23 provided in the movable member 54, are respectively formed to be almost linear. Consequently, each of the lower gas passage 37 and the upper gas passage 38 can be effectively reduced in length. Further, the lower gas passage 37, the connecting gas passage 36 and the upper gas passage 38 provided in the case 30 forms in entirety a single common gas passage used to be coupled through the common gas passage 23 in common with the bullet shooting gas passage 21 and the bullet supplying gas passage 22.

In the condition wherein the case 30 is held in the grip 6 in such a manner as shown in FIGS. 1 and 2, the upper end portion 31*a* of the magazine 31 is positioned to be close to the bullet holding chamber 4*a* and closed by the mid portion of the movable member 54. Therefore, the sham bullets BB contained in the magazine 31 are pushed against the elastic force by the coil spring 32. One end portion of the piston 35 projects from the case 30 into the grip 6 to come into contact with the rod 43 extending from the movable pin 40 and to push a movable lever 45 in the grip 6 downward against the elastic force by a coil spring 44 by which the movable lever 45 is put in tendency of moving upward. Further, the upper gas passage 38 is coupled through the coupling portion constituted by the movable tubular sealing member 47 with the common gas passage 23 in the movable member 54 and the other end portion of the connecting gas passage 36 is closed by the valve portion 35*a* of the piston 35.

Figure 3:
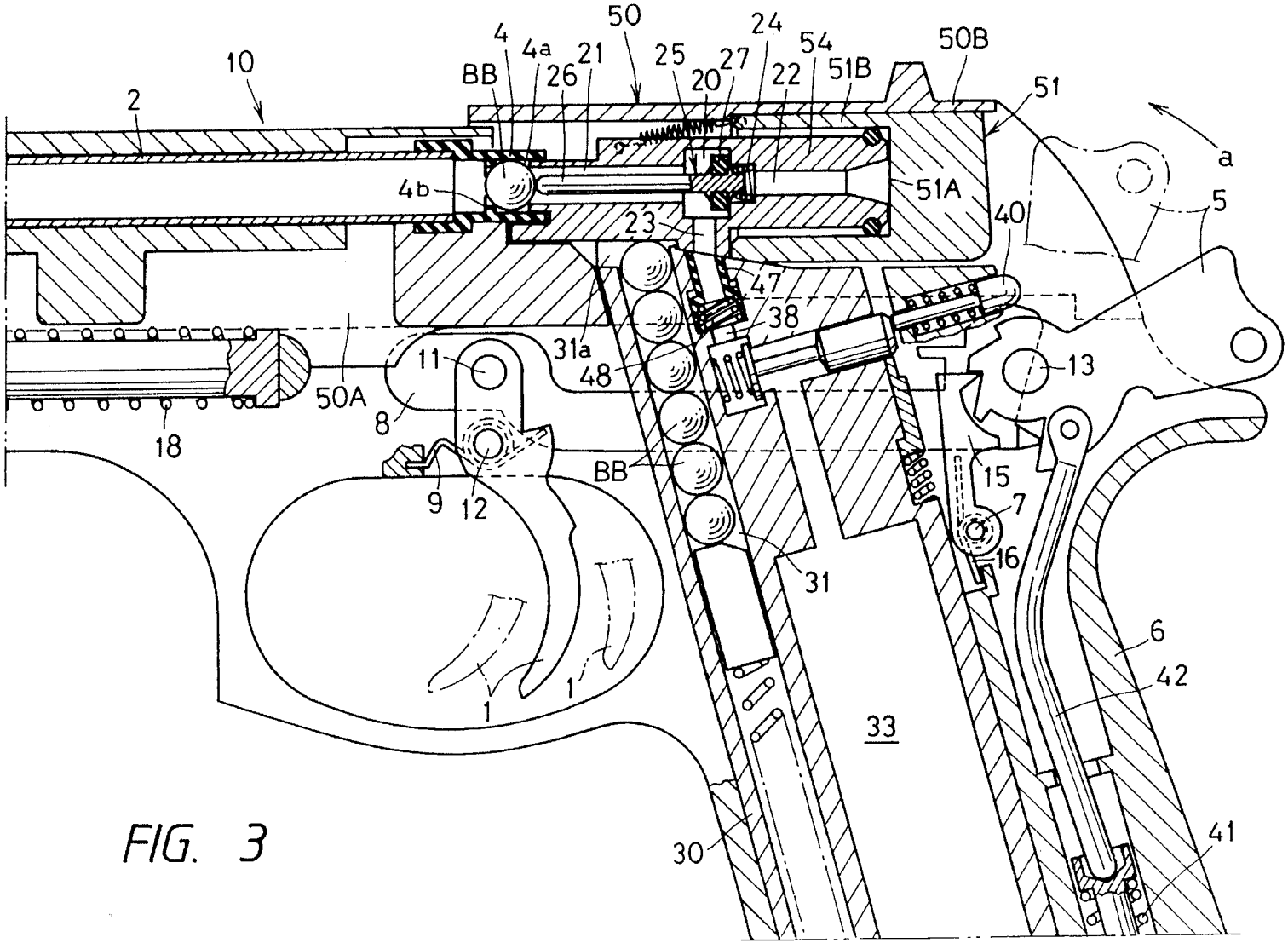
FIGS. 3, 4, 5, 6, 7, 8, 9, 10, 11 and 12 are schematic cross sectional views used for explaining the operation of the embodiment shown in FIGS. 1 and 2.

In the embodiment shown in FIGS. 1 and 2 and thus constituted, after the case 30 has been held in the grip 6, the slider 50 is once moved back manually from the reference position and then released to return to the reference position with the elastic force by the coil spring 18. During such movements of the slider 50, the movable member 54 which has its mid portion making the upper end portion 31*a* of the magazine 31 closed is moved back with the backward movement of the slider 50, so that the upper end portion 31*a* of the magazine 31 is made open and one of the sham bullets BB at the top in the magazine 31 is pushed up into the upper end portion 31*a* of the magazine 31 to be held therein by the coil spring 32. Then, the movable member 54 is moved forward with the forward movement of the slider 50 so as to cause the front portion thereof to come into the upper end portion 31*a* of the magazine 31 and to carry the sham bullet BB in the upper end portion 31*a* of the magazine 31 along a slope 10*a* formed in the body 10 to the bullet holding chamber 4*a*. On that occasion, the movable member 54 is operative further to cause the mid portion thereof to make the upper end portion 31*a* of the magazine 31 closed again and to cause the front portion thereof to be coupled again with the rear portion of the tubular member 4 in which the bullet holding chamber 4*a* is formed. As a result, the sham bullet BB is supplied to the bullet holding chamber 4*a* as shown in FIG. 3. The sham bullet BB in the bullet holding chamber 4*a* is appropriately held by the ring projection 4*b* provided in the tubular member 4 and the front portion of the movable member 54 coupled with the rear portion of the tubular member 4.

The sham bullet BB held in the bullet holding chamber 4*a* is in contact with the front end of the rod 26 constituting the gas passage controller 25 in the movable member 54 and thereby the rod 26 is pushed against the elastic force by the coil spring 24. Consequently, the valve 27 mounted on the rod 26 is so positioned as to make the bullet supplying gas passage 22 closed and to cause the bullet shooting gas passage 21 to be connected through the center space 20, the common gas passage 23 and the coupling portion constituted by the movable tubular sealing member 47 to the upper gas passage 38 provided in the case 30.

Further, when the slider 50 is manually moved back, the hammer 5 is rotated by the cup-shaped member 51, which moves back together with the slider 50, from the position shown with a dot-dash line in FIG. 3 against the elastic force by the coil spring 41 in a direction opposite to the a direction and pushes the rotary lever 15 against the elastic force by the toggle spring 16. Then, the hammer 5 engages with the rotary lever 15 at the position distant by a predetermined short distance from the movable pin 40 to be fixed in position, as shown with a solid line in FIG. 3. On that occasion, the trigger 1 is once rotated from the reference position shown with a dot-dash line in FIG. 3 to the finishing position shown with a double dot-dash line in FIG. 3 in accordance with the backward movement of the slider 50 and then rotated reversely from the finishing position to a waiting position as shown with a solid line in FIG. 3 in accordance with the forward movement of the slider 50 for returning to the reference position.

After the slider 50 has returned to the reference position, when the trigger 1 is pulled to rotate from the waiting position shown with the solid line in FIG. 3 toward the finishing position shown with the double dot-dash line in FIG. 3, the movable bar member 8 is moved forward in accordance with the rotating movement of the trigger 1. During the forward movement of the movable bar member 8, an engaging projection 8*a* provided on the rear portion of the movable bar member 8 causes the rotary lever 15 to rotate against the elastic force by the toggle spring 16 and an engaging projection 8*b* provided on the rear portion of the movable bar member 8 engages with a top end portion of the movable lever 45, as shown in FIG. 4.

Figure 4:
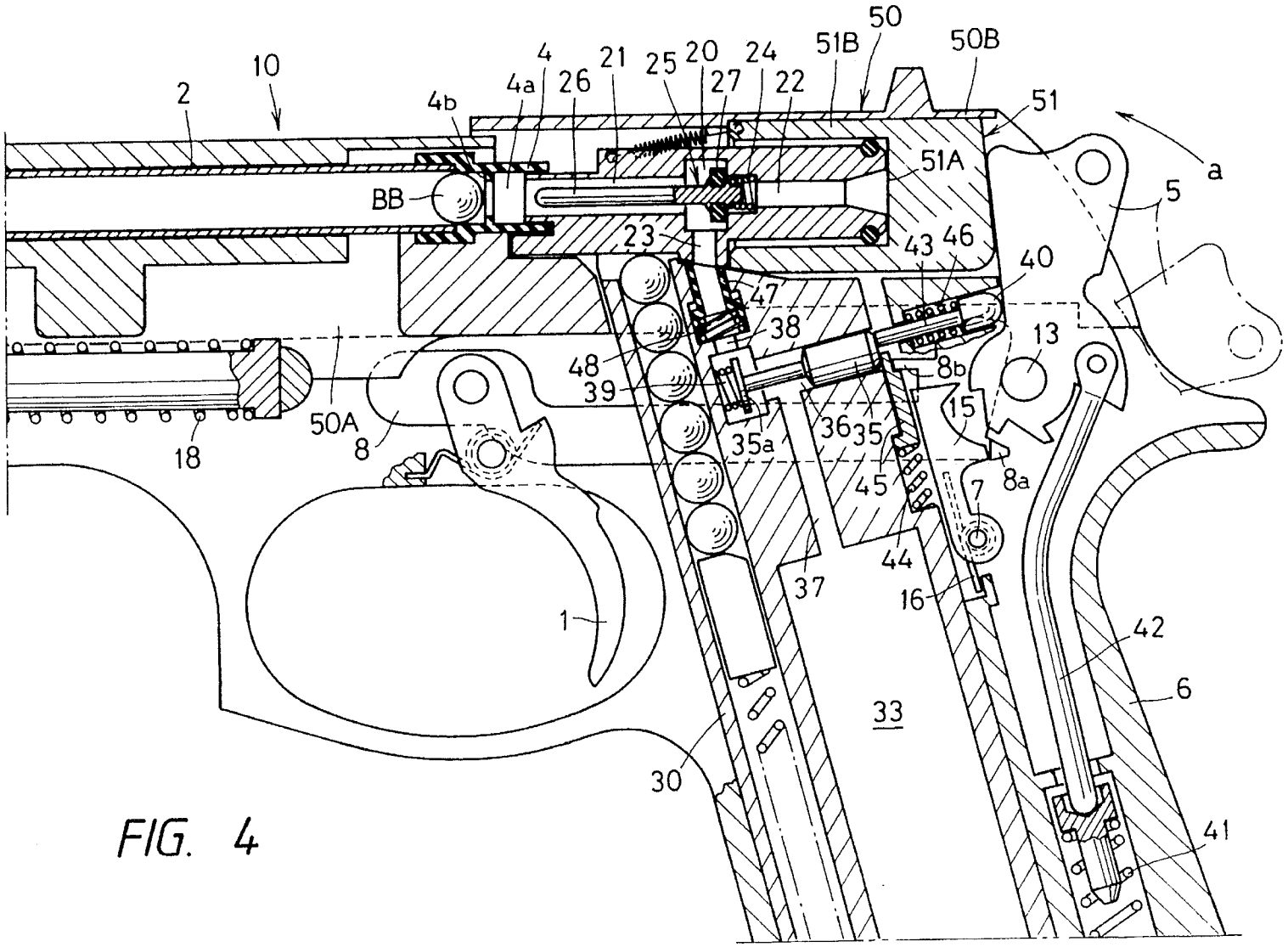

The hammer 5 is disengaged from the rotary lever 15 due to the forward movement of the movable bar member 8 and rotated by the coil spring 41 in the a direction from the position distant by the predetermined short distance from the movable pin 40, as shown with a dot-dash line in FIG. 4, to strike the movable pin 40 and then come into contact with the rear end of the cup-shaped member 51 at substantially the same time at which the trigger 1 reaches the finishing position. The movable pin 40 which is struck by the hammer 5 is pushed against the elastic force by the coil spring 46 and the piston 35 is pushed by the rod 43 extending from the movable pin 40 against the elastic force by the coil spring 39. The piston 35 thus pushed allows the movable lever 45 to be moved upward by the coil spring 44. The movable lever 45 pushed upward prevents the piston 35 from moving to the outside of the case 30 by the coil spring 39 to be so positioned in the connecting gas passage 36 that the valve portion 35*a* of the piston 35 makes the other end portion of the connecting gas passage 36 open.

Figure 5:
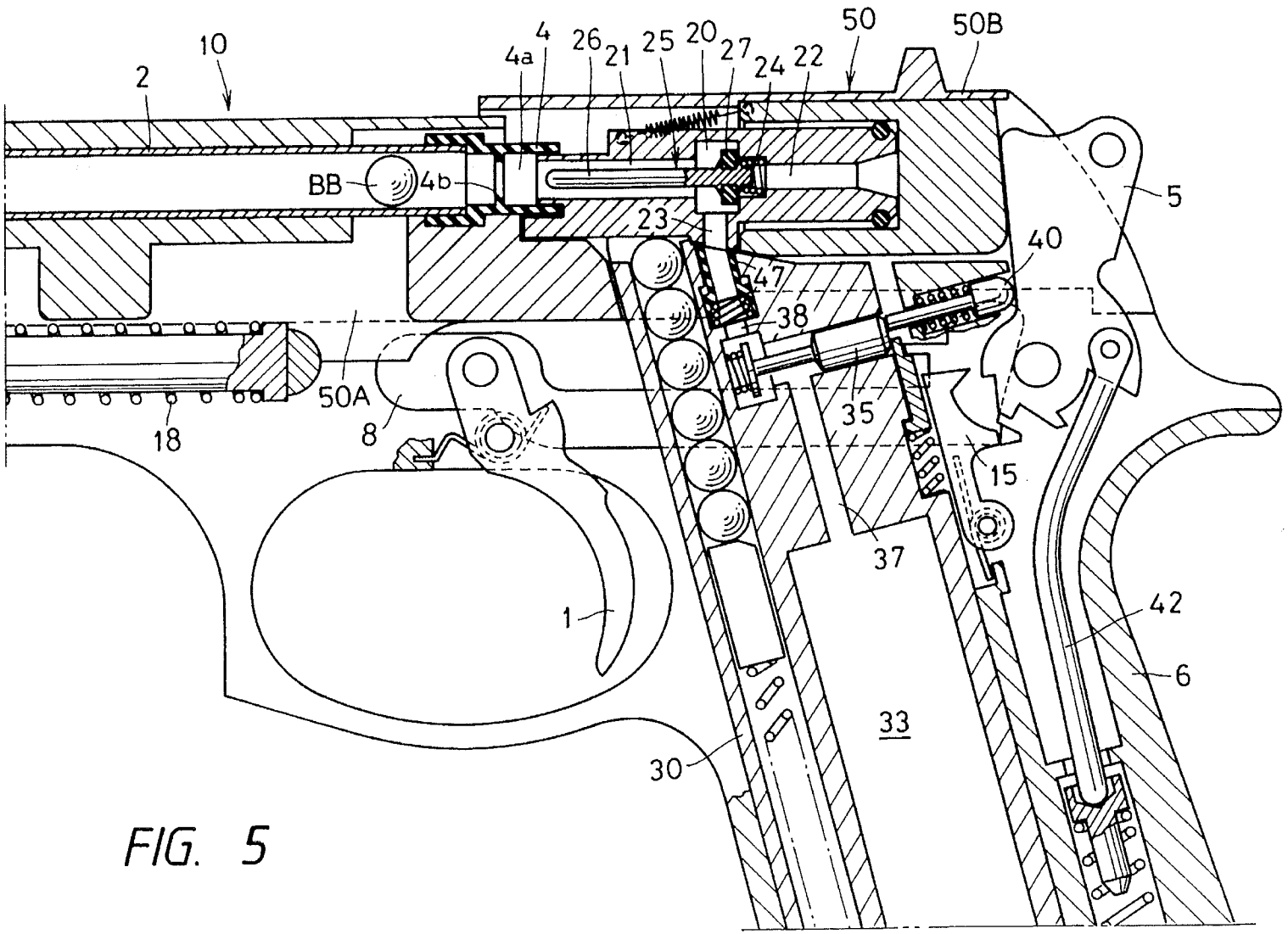

Under such a situation, the bullet shooting gas passage 21 which is made open by the valve 27 constituting the gas passage controller 25 is connected with the pressure accumulating chamber 33 in the case 30 and therefore the pressure of the gas discharged from the pressure accumulating chamber 33 is supplied through the lower gas passage 37, the connecting gas passage 36, the upper gas passage 38, the coupling portion constituted by the movable tubular sealing member 47, the common gas passage 23, the center space 20 and the bullet shooting gas passage 21 to the bullet holding chamber 4*a*. Consequently, the sham bullet BB which has been held in the bullet holding chamber 4*a* as shown with a solid line in FIG. 3 is caused by the pressure of the gas supplied to the bullet holding chamber 4*a* to pass over the ring projection 4*b* provided in the tubular member 4 and to move into the front portion of the tubular member 4, as shown in FIG. 4. The pressure of the gas from the pressure accumulating chamber 33 acting on the valve 27 which is making the bullet supplying gas passage 22 closed is operative to prevent the rod 26 from being moved by the coil spring 24 and therefore the valve 27 is kept in the position for making the bullet supplying gas passage 22 closed. When the sham bullet BB in the front portion of the tubular member 4 is further moved into the barrel 2 by the pressure of the gas from the pressure accumulating chamber 33, as shown in FIG. 5, the gas leaks through a relatively small gap formed between the sham bullet BB and the inner surface of the barrel 2 into the barrel 2. With the gas thus leaking into the barrel 2, the speed of the sham bullet BB moving toward a front end of the barrel 2 is accelerated and the pressure of the gas in the center space 20 is reduced.

Figure 6:
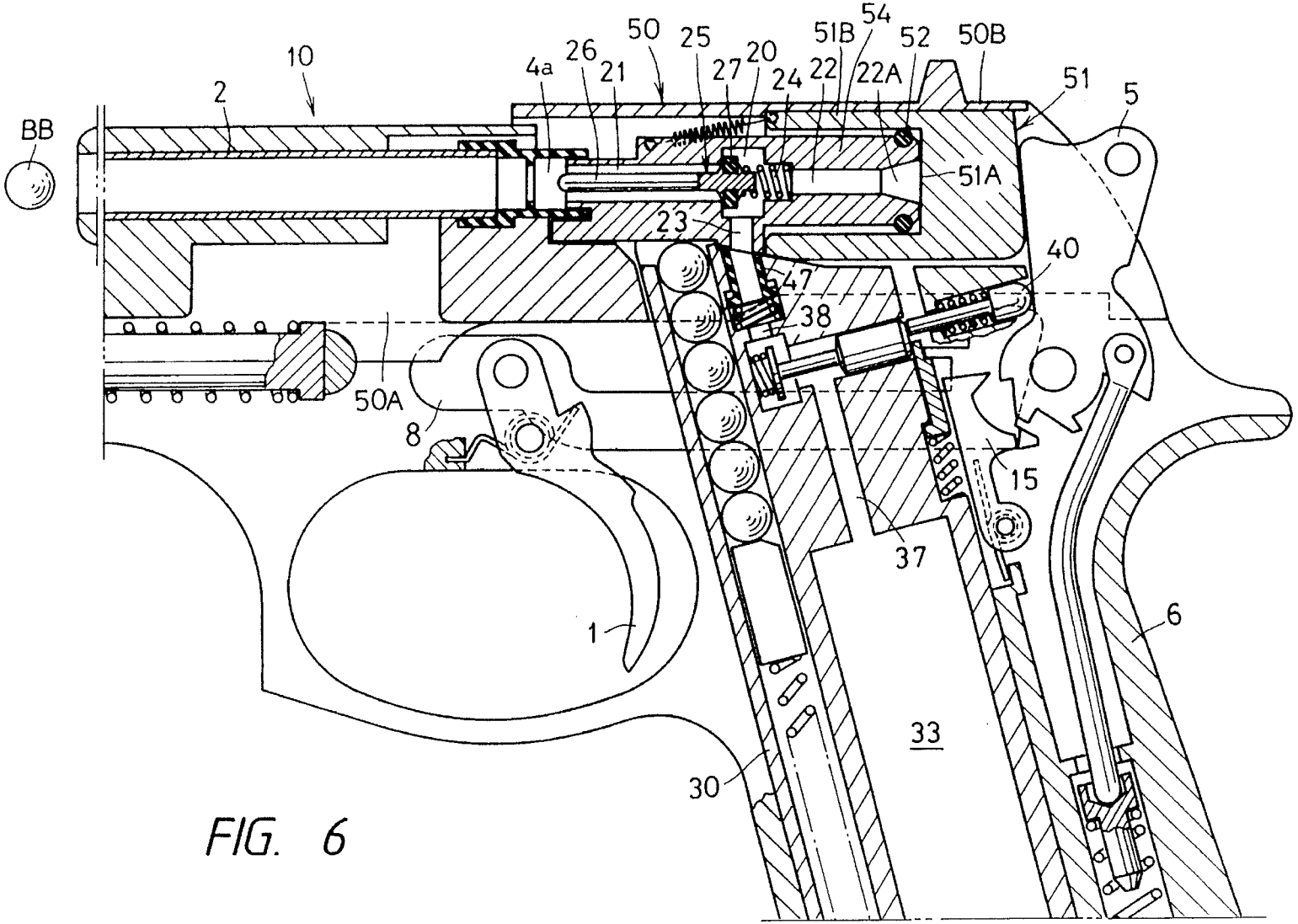

With the reduction in the pressure of the gas in the center space 20, the rod 26 is moved forward by the coil spring 24 and the valve 27 is moved from the bullet supplying gas passage 22 toward the bullet shooting gas passage 21, as shown in FIG. 6. The sham bullet BB moving in the barrel 2 is shot from the barrel 2 before the valve 27 reaches to the position for making the bullet shooting gas passage 21 closed, as shown in FIG. 6.

When the valve 27 is put in the position for making the bullet shooting gas passage 21 closed and the bullet supplying gas passage 22 is connected through the center space 20, the common gas passage 23 and the coupling portion constituted by the movable tubular sealing member 47 with the upper gas passage 38 provided in the case 30, the pressure of the gas supplied from the pressure accumulating chamber 33 to the bullet supplying gas passage 22 acts through the gas exhausting nozzle portion 22A provided at the rear end of the bullet supplying gas passage 22 to the pressure receiving portion 51A constituted by the bottom of the cup-shaped member 51 for pushing the same to go away from the movable member 54.

Figure 7:
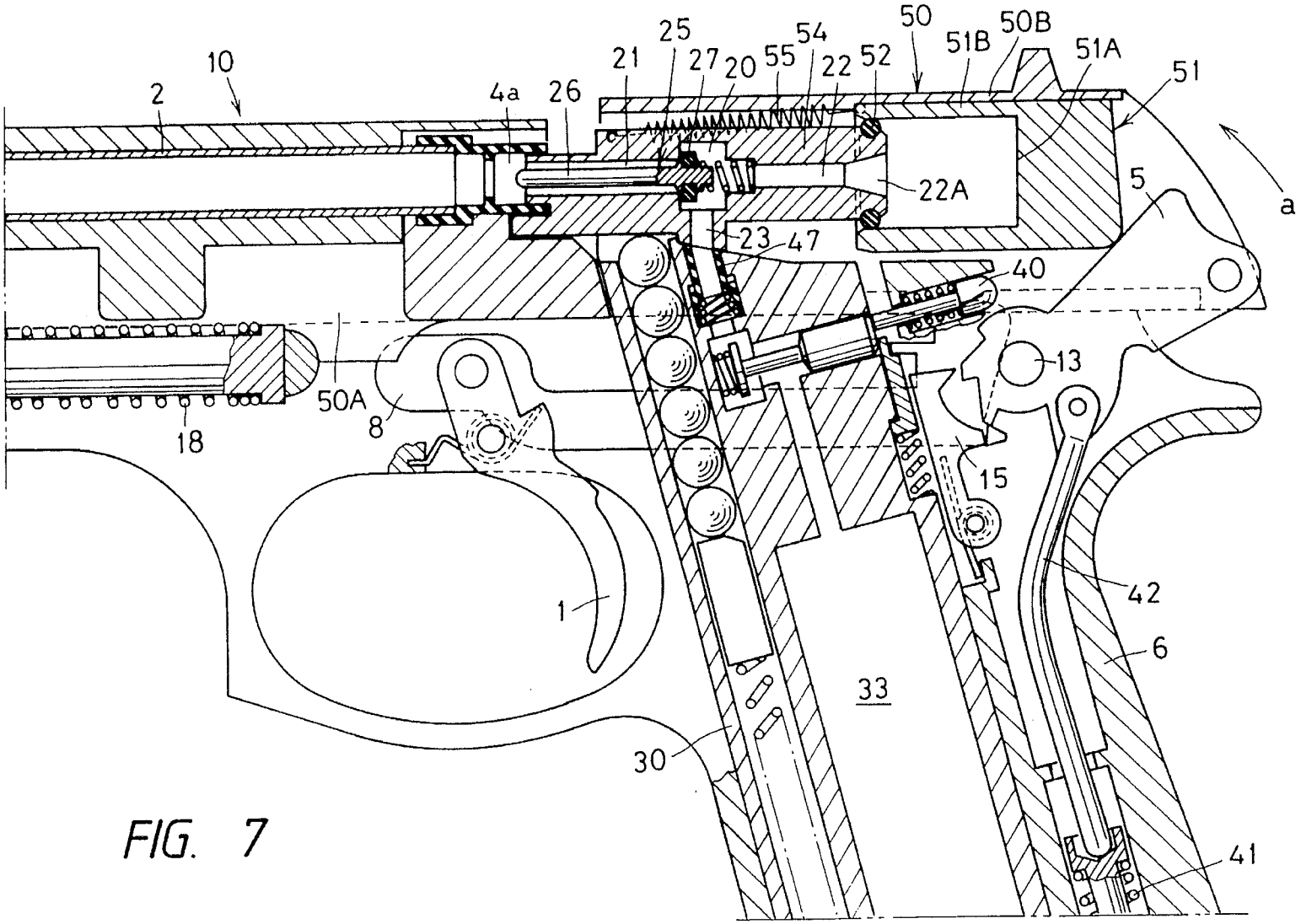

On that occasion, the rear portion of the movable member 54 is inserted in the tubular portion 51B of the cup-shaped member 51 and the sealing ring member 52 mounted on the rear end of the rear portion of the movable member 54 comes into contact with the inner surface of the tubular portion 51B to seal hermetically the space between the outer surface of the rear portion of the movable member 54 and the inner surface of the tubular portion 51B. Therefore, the cup-shaped member 51 having the pressure receiving portion 51A to which the pressure of the gas exhausted through the gas exhausting nozzle portion 22A provided at the rear end of the bullet supplying gas passage 22 acts, is quickly moved back to form a pressure chamber having variable capacity between the pressure receiving portion 51A and the rear portion of the movable member 54 in the tubular portion 51B of the cup-shaped member 51 and therefore the slider 50 is also quickly moved back against the elastic force by the coil spring 55, as shown in FIG. 7. Further, the hammer 5 is rotated by the cup-shaped member 51 moving back together with the slider 50 in the direction opposite to the a direction against the elastic force by the coil spring 41.

As described above, since the backward movement of the slider 50 is automatically started with the pressure of the gas from pressure accumulating chamber 33 acting through the bullet supplying gas passage 22 to the pressure receiving portion 51A after the sham bullet BB has been shot from the barrel 2, the movements of the slider 50 do not exert any bad influence on the barrel 2 at the shooting of the sham bullet BB and therefore the direction of the sham bullet BB shot from the barrel 2 is properly set without being undesirably varied.

Figure 8:
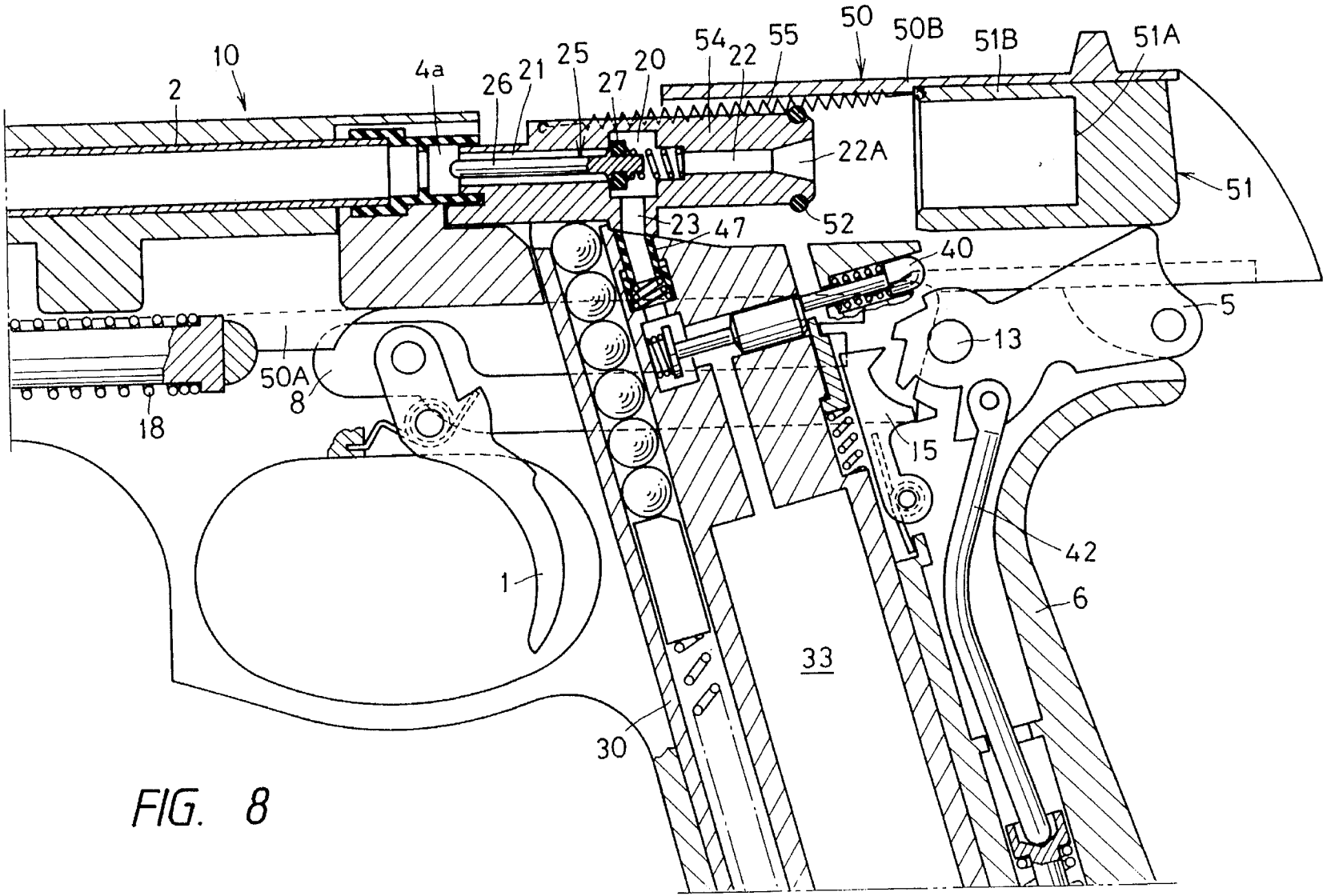
Figure 9:
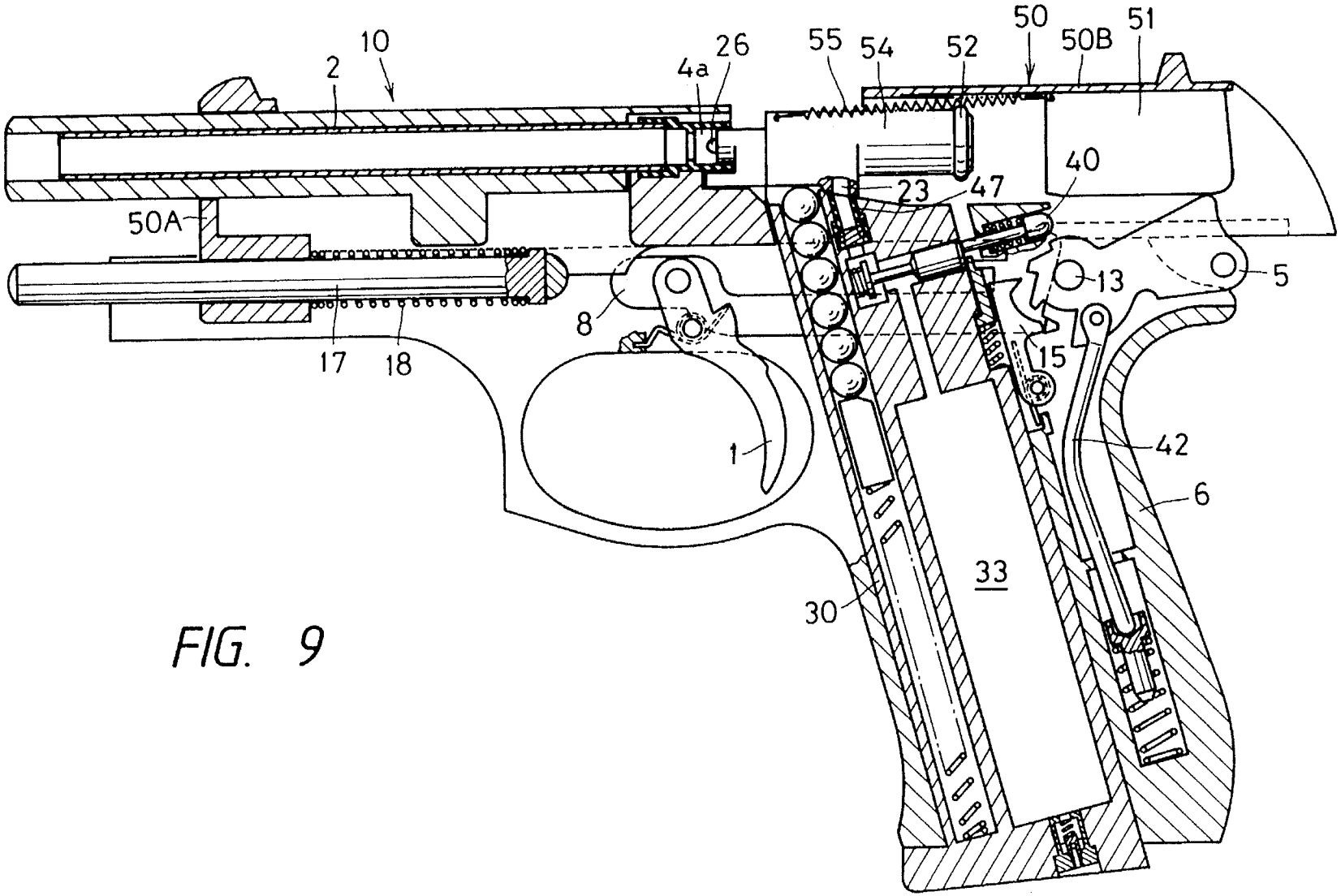
Figure 10:
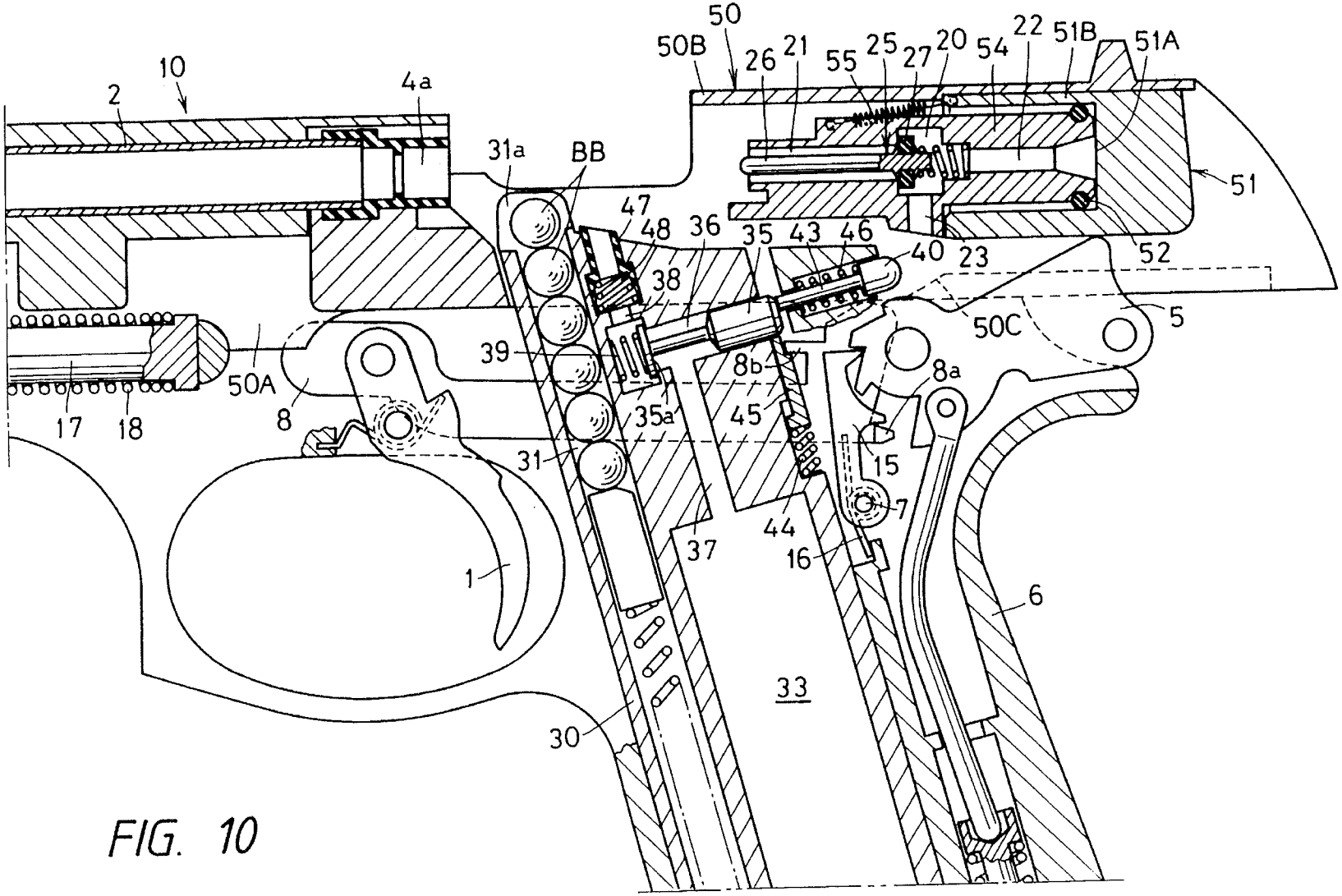

Then, the cup-shaped member 51 is further moved back together with the slider 50, and as a result, the rear portion of the movable member 54 is put out of the tubular portion 51B of the cup-shaped member 51 and the hammer 5 is rotated by the cup-shaped member 51 toward the position distant by the predetermined short distance from the movable pin 40, as shown in FIGS. 8 and 9. Further, as shown in FIG. 10, the movable bar member 8 is rotated to cause the rear portion thereof to go downward by a slope 50C formed on the lower end of the rear portion 50B of the slider 50. The rotary lever 15 is released from the positional restriction by the engaging projection 8*a* provided on the rear portion of the movable bar member 8 to be rotatable and the movable lever 45 is pushed downward against the elastic force by the coil spring 44 by the engaging projection 8*b* provided on the rear portion of the movable bar member 8. Consequently, the rotary lever 15 is rotated by the toggle spring 16 to come into contact with the hammer 5 so that the hammer 5 is kept in the position distant from the movable pin 40 by the rotary lever 15, and the piston 35 is released from the positional restriction by the movable lever 45 and moved by the coil spring 39 to the position for projecting from the case 30.

With the movement of the piston 35 to the position for projecting from the case 30, the valve portion 35*a* of the piston 35 is positioned to make the other end portion of the connecting gas passage 36 closed so that the supply of the gas from the pressure accumulating chamber 33 through the lower gas passage 37, the connecting gas passage 36, the upper gas passage 38, the coupling portion constituted by the movable tubular sealing member 47, the common gas passage 23 and the center space 20 in the movable member 54 to the bullet supplying gas passage 22 in the movable member 54 is stopped. Further, the movable pin 40 is moved by the coil spring 46 to the position for projecting from the grip 6.

Figure 11:
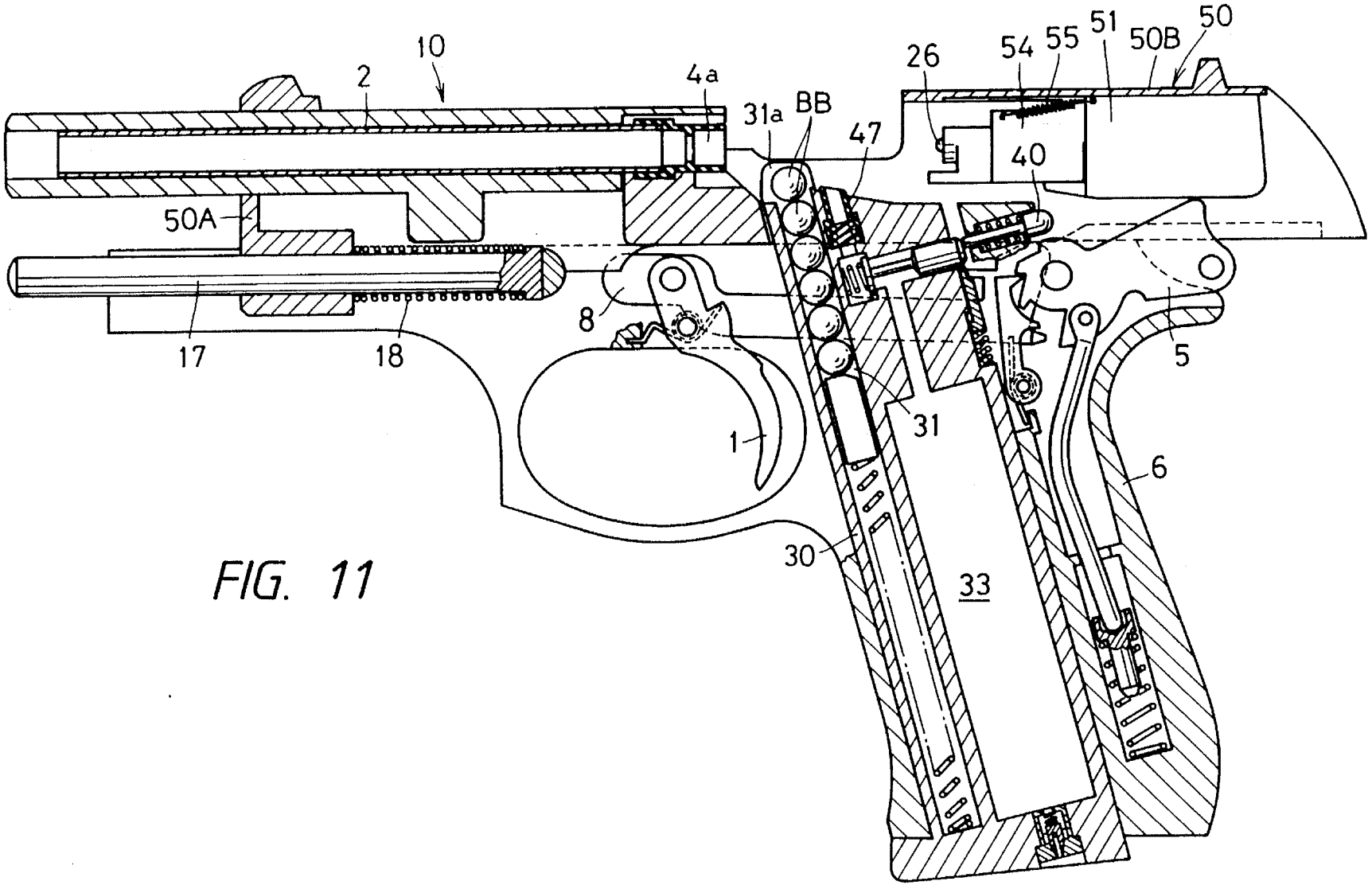

After the supply of the gas from the pressure accumulating chamber 33 to the bullet supplying gas passage 22 in the movable member 54 has been stopped, the slider 50 is further moved back to the rearmost position with the force of inertia. During the backward movement of the slider 50 to the rearmost position, the rear portion of the movable member 54 is put out of the tubular portion 51B of the cup-shaped member 51 so that the pressure of the gas from the pressure accumulating chamber 33 is not supplied to the movable member 54 and the pressure of the gas in the tubular portion 51B of the cup-shaped member 51 is quickly reduced to be the atmospheric pressure because the end of the tubular portion 51B is made open to the atmosphere, and therefore the movable member 54 is rapidly moved back by the coil spring 55 toward the cup-shaped member 51. Then, as shown in FIGS. 10 and 11, the rear portion of the movable member 54 is again inserted in the tubular portion 51B of the cup-shaped member 51. As a result, the upper end portion 31*a* of the magazine 31 which has been closed be the mid portion of the movable member 54 is made open and one of the sham bullets BB at the top in the magazine 31 is pushed up into the upper end portion 31*a* of the magazine 31 to be held therein.

Just after the slider 50 has been reached to the rearmost position, the slider 50 is moved forward by the coil spring 18 toward the reference position and the movable member 54 is also moved forward together with the slider 50. With such forward movement of the movable member 54, the front portion of the movable member 54 carries the sham bullet BB held in the upper end portion 31*a* of the magazine 31 toward the bullet holding chamber 4*a*.

Figure 12:
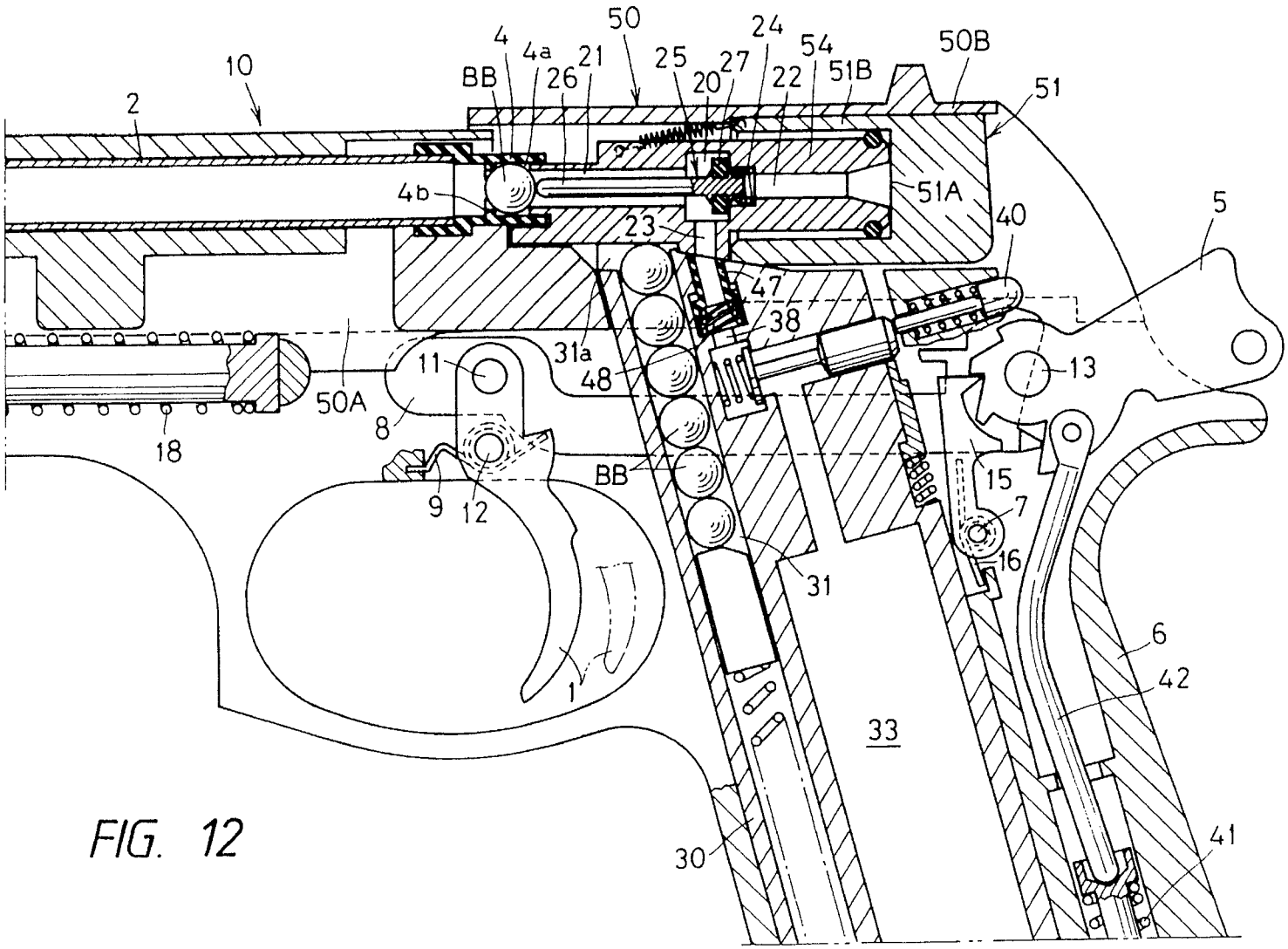

When the slider 50 is put in the reference position again, the sham bullet BB is surely held in the bullet holding chamber 4*a* and the rod 26 constituting the gas passage controller 25 in the movable member 54 is moved back by the sham bullet BB held in the bullet holding chamber 4*a*, so that the valve 27 mounted on the rod 26 is so positioned as to make the bullet supplying gas passage 22 closed and to cause the bullet shooting gas passage 21 to be connected through the center space 20 and the common gas passage 23 to the coupling portion constituted by the movable tubular sealing member 47 provided in the upper gas passage 38 in the case 30, as shown in FIG. 12. Under such a condition, when the trigger 1 is moved from the finishing position as shown with a double dot-dash line in FIG. 12 to the waiting position as shown with a solid line in FIG. 12, the movable bar member 8 is caused to return to the position where the movable bar member 8 was put before the trigger 1 was pulled. After that, when the trigger 1 is pulled again, the shooting of the sham bullet BB held in the bullet holding chamber 4*a* and the supply of a new sham bullet BB to the bullet holding chamber 4*a* are carried out in the same manner as that mentioned above.

As explained above, in the embodiment shown in FIGS. 1 and 2, the gas passage controller 25 operative to control each of the bullet shooting gas passage 21 and the bullet supplying gas passage 22 to be open and closed selectively is provided in the movable member 54 which is positioned above the grip 6 between the bullet holding chamber 4*a* formed in the tubular member 4 and the pressure receiving portion 51A provided in the form of the bottom of the cup-shaped member 51, so that the common gas passage 23 in the movable member 54, the coupling portion constituted by the movable tubular sealing member 47 provided in the case 30 inserted in the grip 6, the upper gas passage 38, the connecting gas passage 36 and the lower gas passage 37, which form the single gas passage in entirety, are used in common for each of the bullet shooting gas passage 21 and the bullet supplying gas passage 22, and the lower gas passage 37 and the upper gas passage 38 are respectively formed to be almost linear. Consequently, each of the gas passage extending from the pressure accumulating chamber 33 through the movable member 54 to the bullet holding chamber 4*a* and the gas passage extending from the pressure accumulating chamber 33 through the movable member 54 to the pressure receiving portion 51A provided in the form of the bottom of the cup-shaped member 51 is effectively shortened in its entirety and relatively simplified in its construction.

In addition, since the common gas passage 23 provided in the movable member 54 is coupled with the upper gas passage 38 provided in the case 30 through the coupling portion constituted by the movable tubular sealing member 47 which is positioned to be movable in the upper gas passage 38 and pushed up by the coil spring 48 toward the outside of the upper gas passage 38, the gas discharged from the pressure accumulating chamber 33 is surely prevented from leaking out from the connection between the common gas passage 23 and the upper gas passage 38.

Accordingly, the consumption of the gas discharged from the pressure accumulating chamber 33, which is required to supply the bullet holding chamber 4*a* with the sham bullet BB and then to shoot the sham bullet BB in the bullet holding chamber 4*a* through the barrel 2, is effectively reduced and therefore the pressure of the gas in the pressure accumulating chamber 33 is gently reduced, various portions operating with the gas discharged from the pressure accumulating chamber 33 can be smoothly moved for a relatively long time after the pressure accumulating chamber 33 is charged with the gas and further the direction of the sham bullet BB shot from the barrel 2 is properly set without being undesirably varied.

Figure 13:
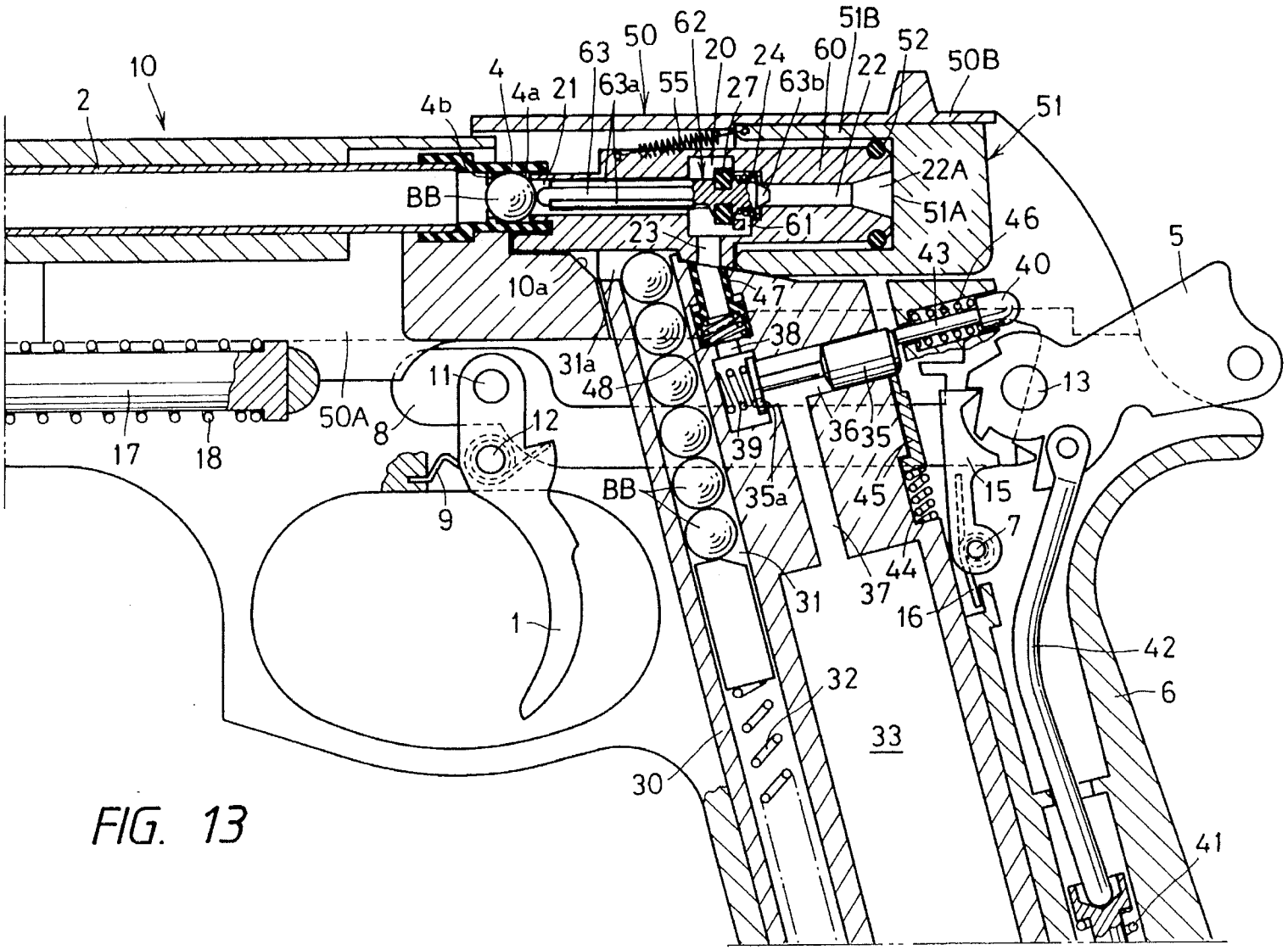
FIG. 13 is a schematic cross sectional view showing another embodiment of model gun with automatic bullet supplying mechanism according to the present invention.

FIG. 13 shows another embodiment of model gun with automatic bullet supplying mechanism according to the present invention. The embodiment shown in FIG. 13 has a movable member and a gas passage controller provided in the movable member which are different from the movable member 54 and the gas passage controller 25 provided in the movable member 54 employed in the embodiment shown in FIGS. 1 and 2, respectively. Portions other than the movable member and the gas passage controller of the embodiment shown in FIG. 13 are substantially the same as the portions other than the movable member 54 and the gas passage controller 25 of the embodiment shown in FIGS. 1 and 2. In FIG. 13, parts and portions corresponding to those in FIGS. 1 and 2 are marked with the same references and further description thereof will be omitted.

Referring to FIG. 13, in a slider 50, a movable member 60 is positioned above a grip 6 between a bullet holding chamber 4*a* and a pressure receiving portion 51A provided in the form of the bottom of a cup-shaped member 51. The movable member 60 is provided therein with a center space 20, a bullet shooting gas passage 21 extending from the center space 20 toward a front end of the movable member 60, a bullet supplying gas passage 22 extending from the center space 20 toward a rear end of the movable member 60, a common gas passage 23 extending from the center space 20 toward the grip 6, and a small gas passage 61 connecting therethrough the bullet supplying gas passage 22 with the center space 20. A gas exhausting nozzle portion 22A having a relatively large diameter is formed at the rear end of the bullet supplying gas passage 22 and a step portion with which one end of a coil spring 24 is engaged is formed at the front end of the bullet supplying gas passage 22 facing to the center space 20. The step portion formed at the front end of the bullet supplying gas passage 22 is connected through the small gas passage 61 with the center space 20.

Further, a gas passage controller 62 is also provided to be movable in the movable member 60. The gas passage controller 62 is constituted by a rod 63 extending from the center space 20 through the bullet shooting gas passage 21 to the bullet holding chamber 4*a* and a valve 27 mounted on the rod 63 to be put in the center space 20. The gas passage controller 62 constituted by the rod 63 is pushed toward the bullet holding chamber 4*a* by the coil spring 24 which has the other end engaging with the rear end of the rod 63 to exert the elastic force to the rod 63. The rod 63 is provided on its portion put in the bullet supplying gas passage 22 with fins 63*a* each extending in the longitudinal direction of the rod 63. An end 63*b* of the rod 63 is provided to be able to come into contact with the front end of the bullet supplying gas passage 22 at which the step portion is formed.

The valve 27 constituting the gas passage controller 62 is provided in the form of an elastic sealing ring member and operative to move between the bullet shooting gas passage 21 and the bullet supplying gas passage 22 in accordance with the movements of the rod 63 for controlling each of the bullet shooting gas passage 21 and the bullet supplying gas passage 22 to be open and closed selectively.

The gas passage controller 62 provided in the movable member 60 constitutes, together with the pressure receiving portion 51A provided in the form of the bottom of the cup-shaped member 51, a pressure acting device which is provided in the slider 50 and operative to make preparations for supplying the bullet holding chamber 4*a* with a sham bullet by using gas pressure supplied thereto.

A coil spring 55 is provided with one end attached to a tubular portion 51B of the cup-shaped member 51 provided in the slider 50 and the other end attached to the movable member 60 for exerting the elastic force to the movable member 60 to put the same in tendency of moving toward the pressure receiving portion 51A which is provided in the form of the bottom of the cup-shaped member 51. When the slider 50 is put in a reference position, the movable member 60 is put in such a position as to cause the front portion thereof to be coupled with the rear portion of a tubular member 4 in which the bullet holding chamber 4*a* is formed and to cause the rear portion thereof to be inserted in the tubular portion 51B of the cup-shaped member 51.

Figure 14:
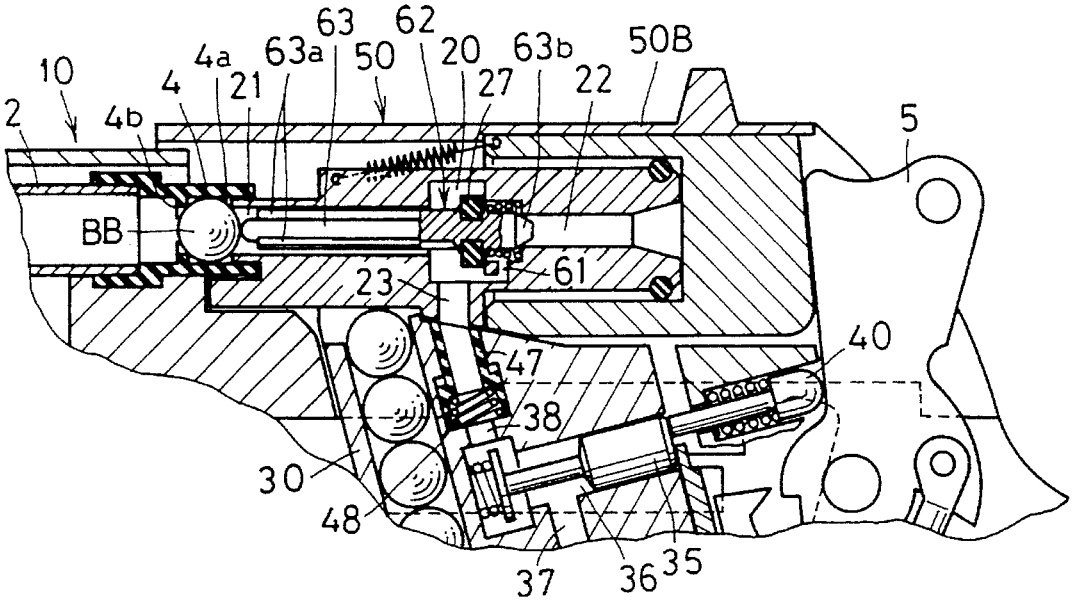
FIGS. 14, 15 and 16 are schematic partial cross sectional views showing essential portions of the embodiment shown in FIG. 13.

In such an embodiment shown in FIG. 13, as shown in FIG. 14, when the gas passage controller 62 is so positioned that the valve 27 makes the bullet shooting gas passage 21 open in the same manner as the gas passage controller 25 and the bullet supplying gas passage 22 closed and a piston 35 is so positioned that a valve portion 35*a* makes a connecting gas passage 36 open, the bullet shooting gas passage 21 is coupled with a pressure accumulating chamber 33 (FIG. 13) provided in the grip 6 and therefore the pressure of the gas discharged from the pressure accumulating chamber 33 is supplied through a lower gas passage 37, the connecting gas passage 36, an upper gas passage 38, a coupling portion constituted by a movable tubular sealing member 47 pushed up by a coil spring 48, the common gas passage 23, the center space 20 and the bullet shooting gas passage 21 to the bullet holding chamber 4*a*. On that occasion, the pressure of the gas supplied through the common gas passage 23 to the center space 20 is further supplied through the small gas passage 61 to the step portion formed at the front end of the bullet supplying gas passage 22. However, the end 63*b* of the rod 63 constituting the gas passage controller 62 is in contact with the front end of the bullet supplying gas passage 22 when the bullet supplying gas passage 22 is closed by the valve 27 constituting the gas passage controller 62 and therefore the pressure of the gas supplied to the step portion formed at the front end of the bullet supplying gas passage 22 is prevented from being further supplied through the step portion to the bullet supplying gas passage 22. Besides, since the gas passing through the small gas passage 61 is of very small quantity, the pressure of the gas supplied to the step portion formed at the front end of the bullet supplying gas passage 22 is extremely smaller than the pressure of the gas in the center space 20 and the bullet shooting gas passage 21.

Figure 15:
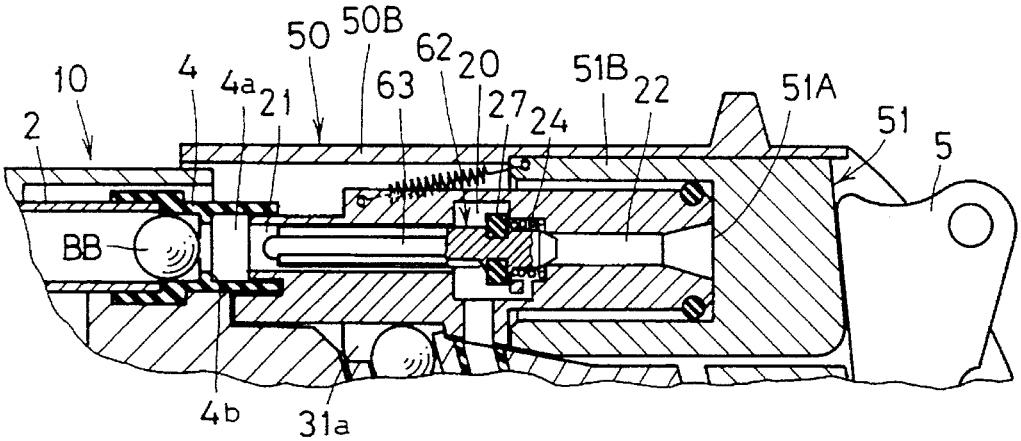

With the pressure of the gas supplied through the bullet shooting gas passage 21 to the bullet holding chamber 4*a*, the sham bullet BB which has been held in the bullet holding chamber 4*a* as shown in FIG. 14 is caused to pass over a ring projection 4*b* provided in the tubular member 4 and to move into the front portion of the tubular member 4, as shown in FIG. 15. On that occasion, the pressure of the gas from the pressure accumulating chamber 33 acting on the valve 27 which is making the bullet supplying gas passage 22 closed is higher than the pressure of the gas supplied to the step portion formed at the front end of the bullet supplying gas passage 22 to act on the valve 27 enough to prevent the rod 63 from being moved by the coil spring 24 and therefore the valve 27 is kept in the position for making the bullet supplying gas passage 22 closed.

Figure 16:
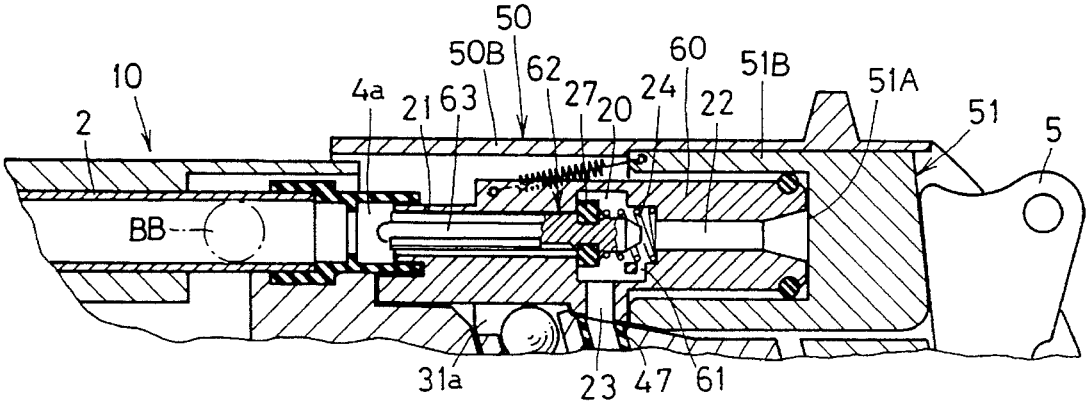

When the sham bullet BB in the front portion of the tubular member 4 is further moved into a barrel 2 by the pressure of the gas from the pressure accumulating chamber 33, as shown with a dot-dash line in FIG. 16, the gas leaks through a relatively small gap formed between the sham bullet BB and the inner surface of the barrel 2 into the barrel 2. With the gas thus leaking into the barrel 2, the speed of the sham bullet BB moving toward a front end of the barrel 2 is accelerated and the pressure of the gas in the center space 20 is reduced. To the contrary, the pressure of the gas supplied through the small gas passage 61 to the step portion formed at the front end of the bullet supplying gas passage 22 increases gradually.

Then, with the reduction in the pressure of the gas in the center space 20 and the increase in the pressure of the gas in the step portion formed at the front end of the bullet supplying gas passage 22, the rod 63 is quickly moved forward by the coil spring 24 and the pressure of the gas acting on the valve 27 on the side of the step portion formed at the front end of the bullet supplying gas passage 22 and the valve 27 is quickly moved from the bullet supplying gas passage 22 toward the bullet shooting gas passage 21. The sham bullet BB moving in the barrel 2 is shot from the barrel 2 before the valve 27 reaches to the position for making the bullet shooting gas passage 21 closed as shown in FIG. 16.

After that, in the same manner as the embodiment shown in FIGS. 1 and 2, the pressure of the gas discharged from the pressure accumulating chamber 33 is supplied through the lower gas passage 37, the connecting gas passage 36, the upper gas passage 38, the coupling portion constituted by the movable tubular sealing member 47, the common gas passage 23, the central space 20 and the bullet supplying gas passage 22 to the pressure receiving portion 51A provided in the form of the bottom of the cup-shaped member 51 and therefore the slider 50 is once moved back from the reference position to the rearmost position and then returned from the rearmost position to the reference position, so that the sham bullet BB held in an upper end portion 31*a* of a magazine 31 is carried to the bullet holding chamber 4*a* so as to be held therein.

As described above, with the embodiment shown in FIG. 13, in addition to the advantages obtained in the same manner as those obtained with the embodiment shown in FIGS. 1 and 2, further advantages resulting from the small gas passage 61 provided in the movable member 60 are obtained as follows.

When the sham bullet BB held in the bullet holding chamber 4*a* has been caused to move into the front portion of the tubular member 4 and then further moved into the barrel 2 by the pressure of the gas supplied from the pressure accumulating chamber 33 through the bullet shooting gas passage 21 to the bullet holding chamber 4*a*, the pressure of the gas having been supplied through the small gas passage 61 to the step portion formed at the front end of the bullet supplying gas passage 22 theretofore acts on the valve 27 on the side of the step portion formed at the front end of the bullet supplying gas passage 22 and therefore the rod 63 constituting the gas passage controller 62 is quickly moved forward by both of the coil spring 24 and the pressure of the gas acting on the valve 27 an the side of the step portion formed at the front end of the bullet supplying gas passage 22, so that the valve 27 is quickly and surely moved into the position for controlling the bullet shooting gas passage 21 to be closed and the bullet supplying gas passage 22 to be open.

Consequently, a series of operations in which the slider 50 is once moved back from the reference position to the rearmost position and then returned from the rearmost position to the reference position by the pressure of the gas from the pressure accumulating chamber 33 after the sham bullet BB has been shot from the barrel 2 and a new sham bullet BB is carried to the bullet holding chamber 4*a* so as to be held therein, is carried out rapidly and exactly with efficient use of the pressure of the gas discharged from the pressure accumulating chamber 33 and therefore the consumption of the gas discharged from the pressure accumulating chamber 33 is further more reduced.

Although the case 30 provided therein with the pressure accumulating chamber 33 in which the liquefied gas is contained is held in the grip 6 in each of the embodiments shown in FIGS. 1 and 2 and FIG. 13, respectively, it is possible to use compressed air in place of the liquefied gas. It is also possible to modify the case 30 to be provided therein a pressure accumulating chamber coupled with a bomb in which a large quantity of liquefied gas or compressed air can be contained.

What is claimed is:

1. A model gun with automatic bullet supplying mechanism, which comprising:

a magazine for containing sham bullets provided in a grip, a pressure accumulating chamber provided in the grip for accumulating gas pressure, a bullet holding chamber provided at the back of a barrel to be close to one end of the magazine, a slider provided to be movable along the barrel, a pressure receiving portion fixed in the slider to be positioned at the back of the barrel and movable with the slider, a movable member provided between the bullet holding chamber the pressure receiving portion to be movable along moving directions of the slider, and a gas passage controller provided to be movable in the movable member for controlling each of a first gas passage extending from the pressure accumulating chamber through the movable member to the bullet holding chamber and a second gas passage extending from the pressure accumulating chamber through the movable member to the pressure receiving portion to be open and closed selectively, said gas passage controller being operative selectively to control the first gas passage to be open so that gas discharged from the pressure accumulating chamber is supplied through the first gas passage to the bullet holding chamber and to control the second gas passage to be open so that gas discharged from the pressure accumulating chamber acts through the second gas .passage on the pressure receiving portion to cause first the slider to move back and then the movable member also to move back for making preparations for supplying the bullet holding chamber with the sham bullet from the end of the magazine.

2. A model gun with automatic bullet supplying mechanism according to claim 1, wherein said pressure receiving portion is provided in the form of a bottom of a cup-shaped member fixed to the slider and gas is discharged from the second gas passage into the inside of the cup-shaped member toward the bottom of the same when the gas passage controller operates to control the second gas passage to be open.

3. A model gun with automatic bullet supplying mechanism according to claim 2, wherein said movable member has a rear portion provided therein with a gas passage forming a part of the second gas passage, said rear portion being put selectively in and out of a tubular portion of the cup-shaped member.

4. A model gun with automatic bullet supplying mechanism according to claim 1, wherein said movable member is provided therein a first common gas passage connected with each of gas passages forming a part of the first gas passage and a part of the second gas passage, respectively, and further coupled, selectively in accordance with the position of the movable member, through a coupling portion with a second common gas passage connected with the pressure accumulating chamber, said coupling portion being constituted by a movable tubular sealing member forced toward the first common gas passage.

5. A model gun with automatic bullet supplying mechanism according to claim 4, wherein said movable tubular sealing member is provided with an upper end coming into contact, selectively in accordance with the position of the movable member, with a portion of an outer surface of the movable member at which the first common gas passage opens.

6. A model gun with automatic bullet supplying mechanism according to claim 1, wherein said movable member is provided therein a first common gas passage connected with each of gas passages forming a part of the first gas passage and a part of the second gas passage, respectively, and further coupled, selectively in accordance with the position of the movable member, through a coupling portion with a second common gas passage connected with the pressure accumulating chamber, said second common gas passage is provided with a valve portion, a first passage portion extending linearly from the pressure accumulating chamber to the valve portion and a second passage portion extending linearly from the valve portion to the coupling portion.

* * * * *